US008311439B2

(12) United States Patent
Bennett et al.

(10) Patent No.: US 8,311,439 B2
(45) Date of Patent: Nov. 13, 2012

(54) FREQUENCY DAMPENING DUCT

(75) Inventors: Glenn A Bennett, Rochester, NY (US); Ali R Dergham, Fairport, NY (US); Karen D Reid, Walworth, NY (US)

(73) Assignee: Xerox Corporation, Norwalk, CT (US)

( * ) Notice: Subject to any disclaimer, the term of this patent is extended or adjusted under 35 U.S.C. 154(b) by 561 days.

(21) Appl. No.: 12/548,616

(22) Filed: Aug. 27, 2009

(65) Prior Publication Data

US 2011/0052244 A1 Mar. 3, 2011

(51) Int. Cl.
*G03G 21/20* (2006.01)

(52) U.S. Cl. ..... 399/92; 399/94; 454/329; 454/906; 165/69

(58) Field of Classification Search ..... 399/92, 399/94

See application file for complete search history.

(56) References Cited

U.S. PATENT DOCUMENTS 4,091,892 A * 5/1978 Hehmann et al. ..... 181/286
5,819,137 A * 10/1998 Hoffman et al. ..... 399/93
2005/0161280 A1* 7/2005 Furuya ..... 181/225

* cited by examiner

*Primary Examiner* — Walter L Lindsay, Jr.
*Assistant Examiner* — Benjamin Schmitt
(74) *Attorney, Agent, or Firm* — Ronald E. Prass, Jr.; Prass LLP

(57) ABSTRACT

This is an environmental unit useful in a xerographic system that reduces or eliminates pulsation and vibration in the system. This is accomplished by the use of flexible bladders on a wall of the air duct work pumping air into the print housing. When the vibration is abated, the banding problems on images are eliminated.

19 Claims, 5 Drawing Sheets

FREQUENCY DAMPENING DUCT

This invention relates to an electrophotographic marking system and more specifically, to environmental units and air ducts to be used in print engines.

BACKGROUND

For clarity, the present invention will primarily be illustrated for use in a monochromatic xerographic marking system; however, this invention can be used equally well in color xerographic systems.

A typical electrophotographic or xerographic reproduction machine employs a photoconductive member that is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas to record an electrostatic latent image on the photoconductive member corresponding to the informational areas contained within the original document.

After the electrostatic latent image is recorded on the photoconductive member, the latent image is developed by bringing a developer material into contact therewith. Generally, the electrostatic latent image is developed with dry developer material comprising carrier granules having toner particles adhering triboelectrically thereto. The toner particles are attracted to the latent image, forming a visible powder image on the photoconductive surface. After the electrostatic latent image is developed with the toner particles, the toner powder image is transferred to a sheet. Thereafter, the toner image is heated to permanently fuse it to the sheet.

It is highly desirable to use an electrostatographic reproduction machine of this type to produce color prints. In order to produce a color print, the electrostatographic reproduction machine includes a plurality of stations. Each station has a charging device for charging the photoconductive surface, an exposing device for selectively illuminating the charged portions of the photoconductive surface to record an electrostatic latent image thereon, and a developer unit for developing the electrostatic latent image with toner particles. Each developer unit deposits different color toner particles on the respective electrostatic latent image. The images are developed, at least partially, in superimposed registration with one another, to form a multicolor toner powder image.

The resultant multicolor powder image is subsequently transferred to a sheet. The transferred multi-color image is then permanently fused to the sheet forming the color print.

In both monochromatic and color systems, several stations including charging stations, exposure stations, developer stations, transfer stations, etc. are used. Each station has several delicate components that must be in controlled environments to maintain proper temperatures, humidity and other system conditions. To effectuate this control, an environmental unit (EU) is used. The prior art environmental units (EU) include a rotary positive blower to move conditioned air from the EU into the print engine of the xerographic system in order to maintain and control temperature and humidity. The use of an EU is necessary in most xerographic marking systems in order to produce quality prints. Most blowers introduce pulsations into the air stream at a frequency of about 200-400 Hz which is a function of the motor RPM and the number of blades on the impeller. This pulsation causes vibration throughout the xerographic stations and eventually results in banding problems in the image created. These spaced streaks on the print or image reflect the pulsation or vibration caused by the EU blower. Obviously, these visibly flawed images are not acceptable and require correction.

In order to correct this banding problem, cushions or soft pads were positioned around all shock mountings, which involved a considerable amount of time and cost for each of several mounts and yet did not fully correct the vibration problem that caused the image banding. This prior art corrective measure is illustrated in FIG. 3 of this disclosure. A more effective economical and simpler way to correct this banding problem is needed.

SUMMARY

The present invention provides a solution to this air pulsation and vibration problem by adding at least one passive dampening elastomeric bladder to existing duct work that transports air into the print engine. This invention with at least one bladder dampener is easily retrofitted into existing EUs. This invention includes an effective and economical modification to the existing air duct. A section of the duct wall will be removed and replaced with a sheet of an elastic bladder material. The geometry and elasticity of the bladder material will be calculated and tuned to respond and dampen out the Hz pulsation to be corrected. Preferably, this elastomeric dampening material can be added to both sides of the duct if additional and more effective control is required.

As pressure increases due to the impeller blade rotation, the bladder inflates causing pressure in the duct to remain constant. Conversely, as the impeller blade passes the blower outlet, the pressure drops, the bladder deflates to continuously maintain constant pressure dampening out variation. By effectively changing the duct volume with pressure variation, pressure remains constant, vibration significantly reduced and banding is reduced below visual perceptibility.

The bladder may be made from any suitable elastomer including rubber, silicone, latex, or any other suitable vibration dampening materials. The bladder obviously must be resilient and flexible and designed to achieve the intended vibration dampening objective. Preferably, for best results, the elastomeric bladder doesn't exceed a thickness of about 1 mm, but is preferably about 0.2 to 0.5 mm thick. However, any effective vibration dampening thickness is included within the scope of this invention. The bladder is positioned on at least one side wall of the duct work that transports air into the print engine. Placing the bladder on both sides or walls of the duct work is preferred for maximum effect.

DETAILED DISCUSSION OF THE DRAWINGS AND PREFERRED EMBODIMENTS

Figure 1:
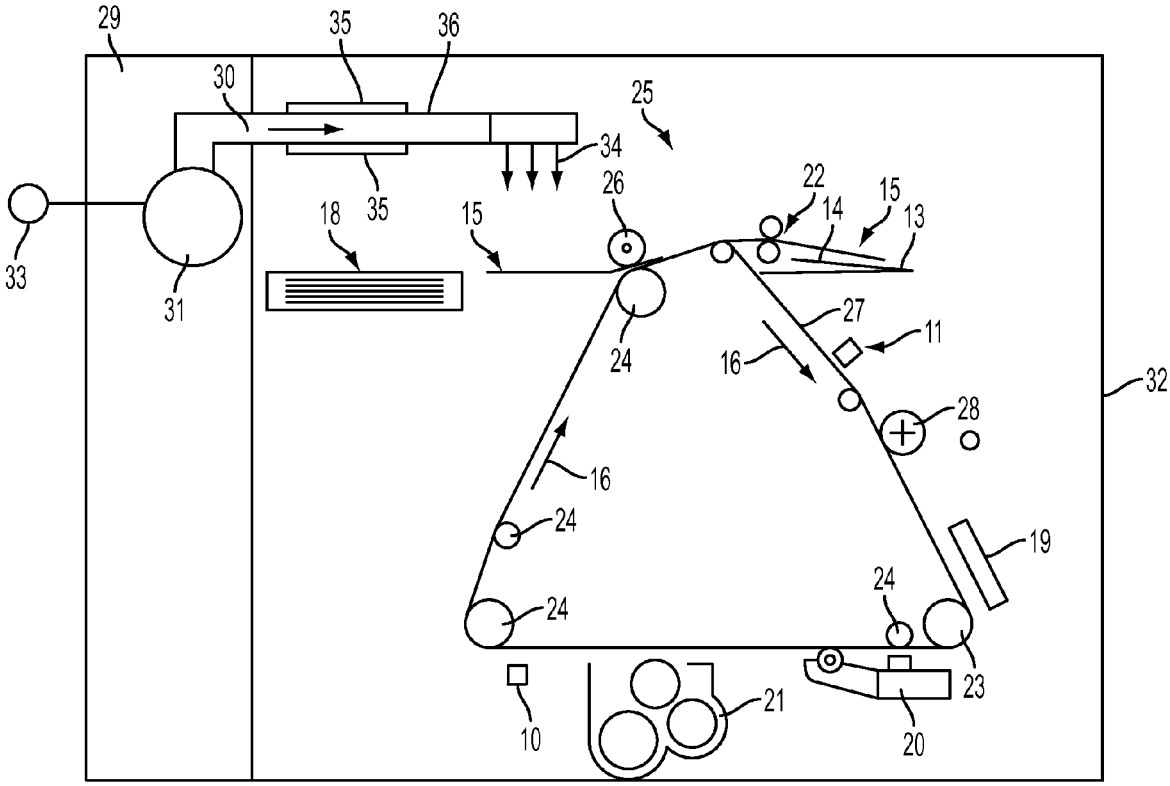
FIG. 1 is a schematic illustrating a monochromatic xerographic marking system where the present invention is utilized.

In FIG. 1 a monochromatic, xerographic system 25 is illustrated where sensor 10 determines system conditions, i.e. heat, humidity. The environmental conditions, transfer system electrical characteristics, the paper or substrate characteristics, and the measurements provided by sensors 10 and 11 are factored into the settings of Environmental unit 29 to optimize transfer performance and provide more optimized system conditions and a more precise and better quality image. In FIG. 1, the xerographic system 25 contains a stacking assembly 13 at collection station 14, paper 15, arrows of photoconductor belt 27 with arrow movement 16, paper feed 18, a charging station 19, an exposure station 20, a developer station 21, a cleaning station 28 and a fusing station 22. All of these stations must have minimized vibration of components caused by air pulsation. The transfer station 26 and adjacent sensors 10 and 11 provide important measurements of system temperature, humidity, and electrical characteristics so that a proper elastomeric bladder can be selected.

The current environmental unit (EU) 29 includes a rotary positive blower 31 to move conditioned air via conduit 30 from the EU into the xerographic housing 32 to maintain temperature and humidity control. The blower 31 introduces pulsation into the air stream 34 at a frequency of about 200-300 Hz, which is a function of the motor RPM and the number of blades on the impeller. The pulsation causes a banding problem which is spaced streaks on the print relative to the pulsation frequency that is visible and unacceptable. This invention solves the air pulsation problem by adding a passive elastomeric dampening bladder 35 or two or a flexible membrane 35 on one or each side wall of the existing duct work 36 that transports air into the print engine. Selection of reservoir size, membrane 35 size and membrane material should allow the duct 36 to be tuned to absorb the unwanted frequency airstream pulses. A controller 33 of blower 31 in communication with sensors 10 and 11 sets the parameters of the desired air flow 35 into print engine 32.

Figure 2:
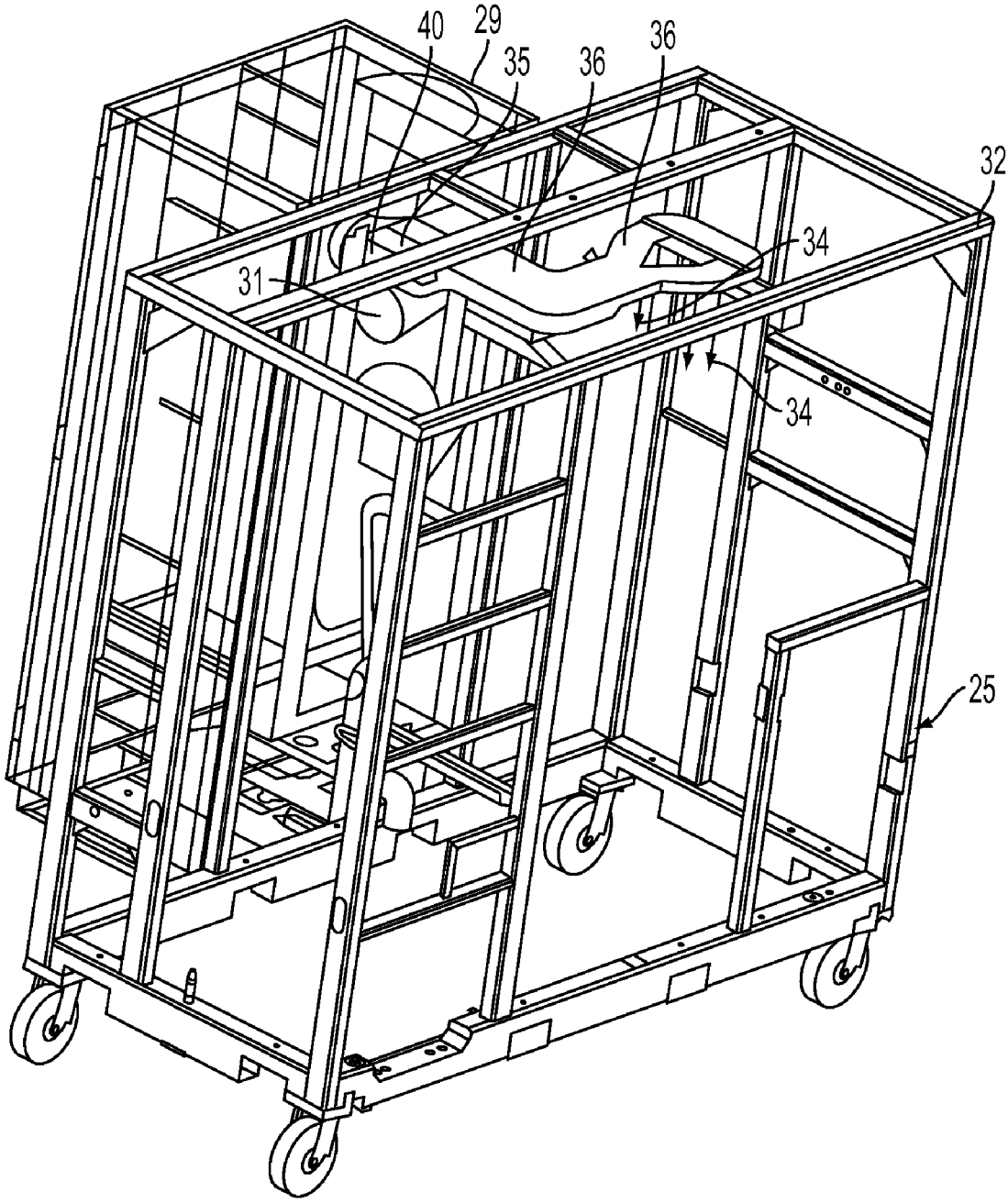
FIG. 2 is a perspective showing the interrelationship between the print engine and the environmental unit of this invention.

FIG. 2 is a side perspective illustration showing the connection of the environmental unit 29 with the print engine 25 or print housing 32. The specifics of print engine 25 and housing 32 are eliminated for ease, of understanding and to show the positioning of duct work 36 vis a vis print housing 32. The duct work 36 is attached to a blower 31 and enters print housing 32 via air conduit 30. The duct work 36 has on at least one side the dampening bladder 35 (the bladder 35 on two sides is preferred for best results). This bladder significantly reduces the pulsation and vibration caused by the blower 31. This pulsation can cause a banding problem and image defects that are corrected by the present invention. The elastic bladder 35, as pressure increases due to the impeller blade rotation, inflate causing pressure in the duct 36 to remain constant. By effectively changing the duct volume with pressure variation, pressure remains constant and vibration significantly reduced.

Figure 3:
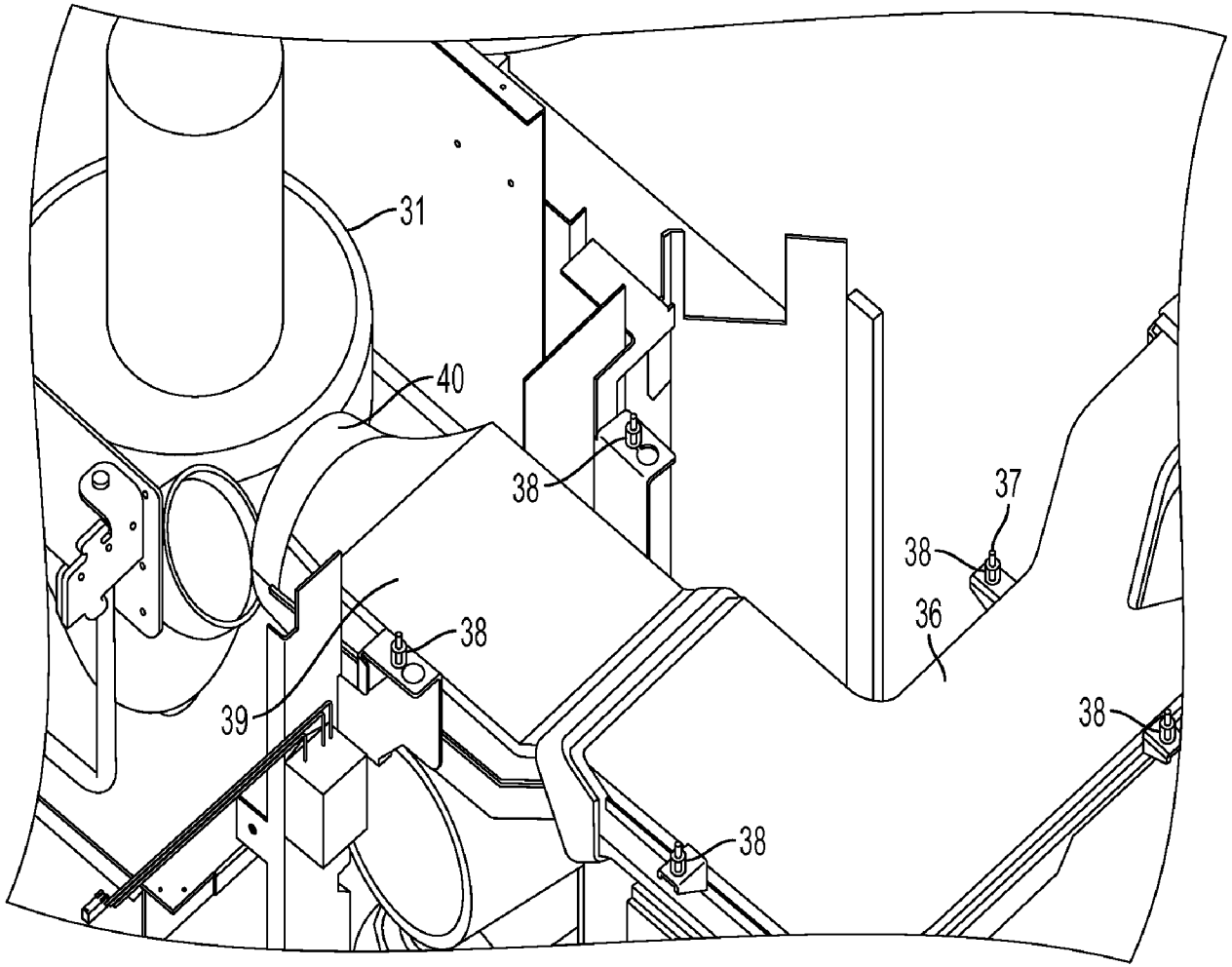
FIG. 3 PRIOR ART
FIG. 3 is a perspective illustrating the prior art's attempt to correct the vibration and pulsation problem by putting padding around each mount.

In FIG. 3 the prior art fix to the discussed vibration or pulsation is shown. Shock mounts 37 are fitted with cushions 38 to help absorb vibration in the system 25. Several shock mounts 37 need to be attended to resulting in additional expense and time to retrofit or install originally. In addition to the large number of mounts 37 that must be attended to, the resulting image banding problem was not significantly reduced. Solid sides 39 on the duct work 36 is replaced by the flexible elastomeric bladders 35 as shown in FIG. 4 of this invention with significant improvement.

Figure 4:
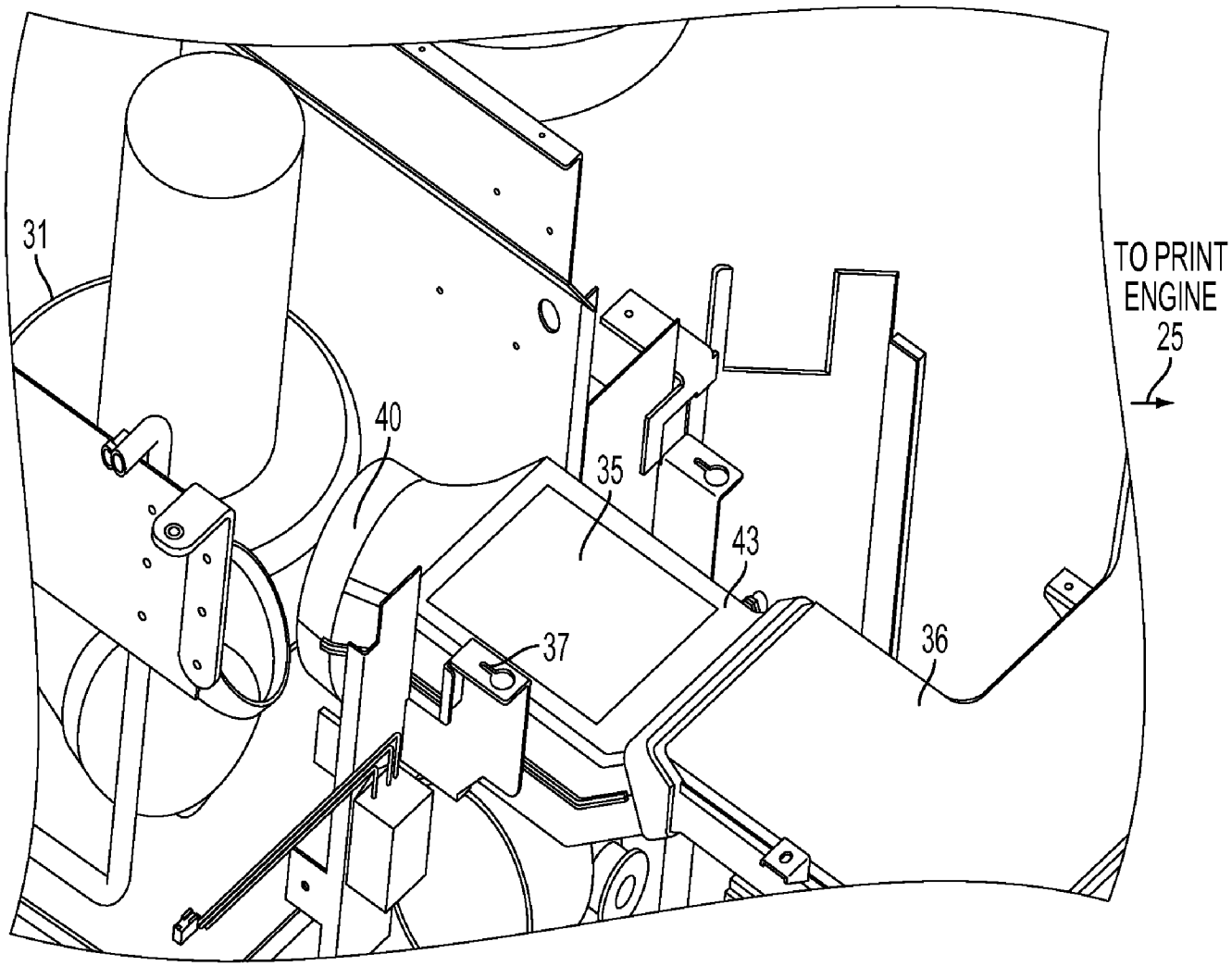
FIG. 4 is an embodiment of the present invention where the prior art mounts of FIG. 2 are replaced by the vibration absorbing bladder on the duct work.

In FIG. 4, the assembly of prior art (as shown in FIG. 3) is illustrated with the bladders 35 of this invention retrofitted in the duct work 36. The top of duct work 36 is shown with bladder 35 installed; however, an additional bladder 35 is installed immediately below (not shown in FIG. 4 but shown in FIGS. 1 and 5).

Figure 5:
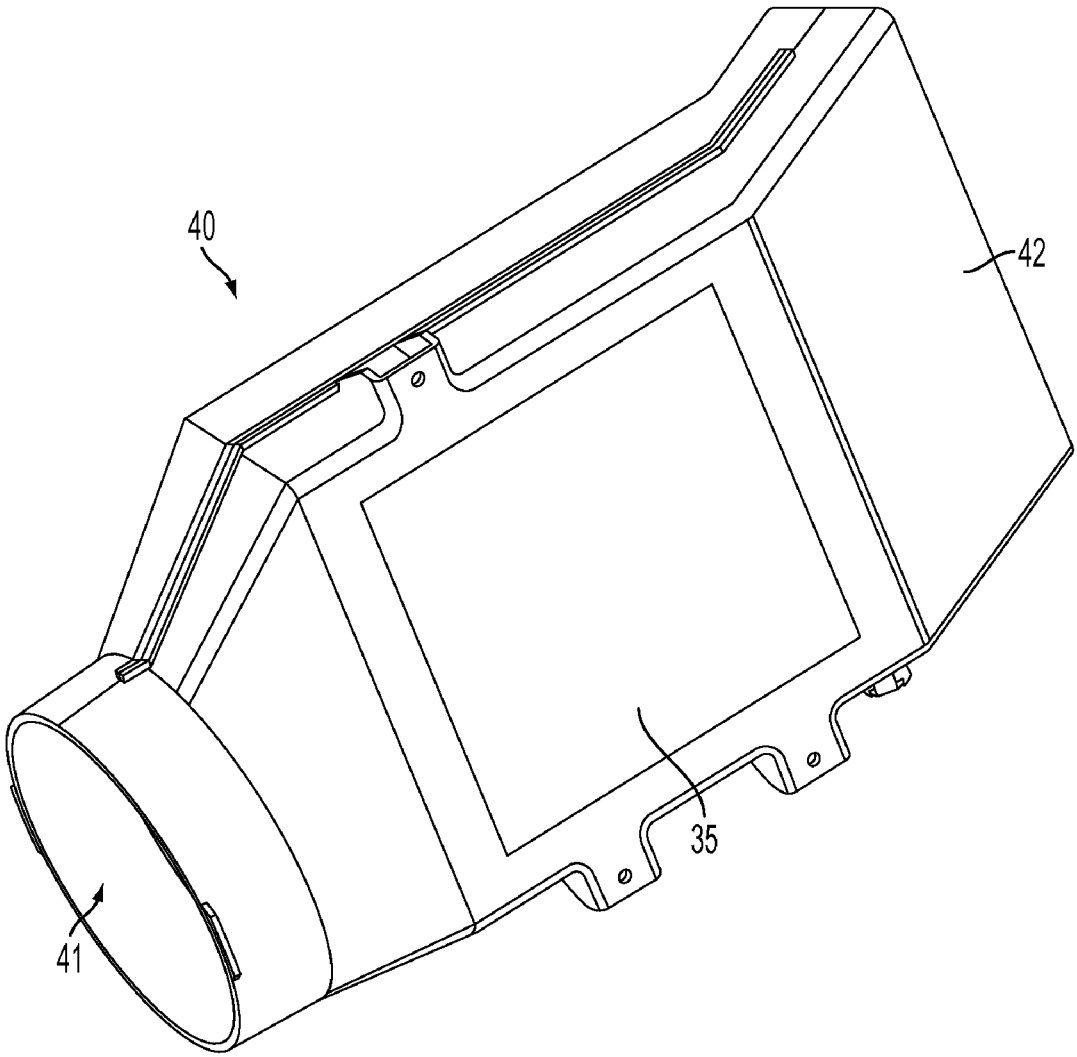
FIG. 5 is a perspective side view of the duct work of the present invention with at least one vibration absorbing bladder material installed.

In FIG. 5 a unit 40 of duct work 36 is shown having a bladder 35 on its front side and optionally a second bladder 35 on the opposite side of unit 40. The duct unit 40 has an air inlet 41 from blower 31 and an air outlet 42 to the print engine 25 and housing 32. The location of unit 40 can be seen in FIGS. 2, 3, and 4 as it is installed in the xerographic system 25-environmental unit 29.

In summary, the present invention provides a novel xerographic marking system, a novel environmental unit (EU) and a novel duct work assembly.

The xerographic or electrophotographic marking system comprises conventional xerographic stations in a printing engine housing and an environmental unit (EU) configured to maintain and control ambient conditions within this housing. The EU comprises an air blower connected to duct work. The duct work is configured to provide air communication from the blower to the housing. The duct work extends through a conduit in the housing in order to transport air from the air blower to the xerographic housing. The duct work has an air outlet and comprises on at least one wall of the duct work a flexible elastomeric bladder that is configured to dampen out any pulsation or vibration caused in the housing by the EU.

In a preferred embodiment, the flexible bladder is positioned on walls of two sides of the duct work. To be effective, at least one flexible bladder is positioned on the duct work between the air blower and the duct work air outlet. The duct work comprises at one end thereof an air inlet portion located adjacent to the air blower and at an opposite end thereof an air outlet that extends within the xerographic housing. The duct work comprises adjacent an air inlet a relatively rectangular shaped duct unit; the duct unit has a bladder positioned on each longitudinal side wall of the duct unit. The bladder comprises an expandable and flexible elastomeric material having a thickness not exceeding about 1 mm but preferably is 0.2 to 0.5 mm thick.

The environmental unit (EU) is configured for use in the electrophotographic marking apparatus. The EU comprises duct work connected at one end to an air inlet portion adjacent an air blower. The duct work has at an opposite end an air outlet portion. This air outlet portion is configured to extend into a housing of an electrophotographic marking apparatus. Positioned on a wall or walls of the duct work at a location between the air inlet portion and the air outlet portion is at least one flexible bladder. This bladder has one outer side adjacent the atmosphere and an opposite inner side adjacent to air being transported by the EU. This elastomeric bladder is configured to dampen out any pulsation or vibration caused in the housing of the electrophotographic marking apparatus. The bladder is preferably positioned on two walls of the duct work prior to the air outlet portion. The bladder is made of an elastomeric material selected from the group consisting of rubber, latex, silicone and other suitable flexible materials. The bladder comprises a material having a thickness not exceeding about 1 mm but has preferably a thickness of about 0.2 to 0.5 mm. The bladder is tuned, configured and selected to respond to dampening out of any Hz pulsation caused by air passing through the air outlet. The EU comprises a rotary positive blower configured to move via the duct work conditioned air from the EU to the housing of the electrophotographic marking apparatus. The EU is configured to maintain proper temperature and humidity conditions within the housing.

The EU of this invention wherein the air blower is configured to introduce pulsation into an air stream traveling through the duct work has pulsation with a frequency of about 200 to 400 Hz.

The at least one flexible bladder is configured to dampen the pulsation in the housing and avoid any banding in an image produced by the electrophotographic marking apparatus.

Lastly, the present invention provides a novel duct work assembly configured to transport an air stream into an electrophotographic marking apparatus. The duct work comprises at one end an air inlet portion connected to an air blower and at an opposite end an air outlet portion configured to be in air flow contact with the electrophotographic marking apparatus. The duct work has a duct unit with a substantially rectangular configuration and this duct unit has on at least one side wall thereof a flexible elastomeric bladder. The bladder is made from an elastomeric material and has a thickness not exceeding about 1 mm but has preferably a thickness of from 0.2 mm to about 0.5 mm.

It will be appreciated that variations of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. An electrophotographic marking system, comprising:

xerographic stations in a housing; and an environmental unit (EU) configured to maintain and control ambient conditions within the housing, the EU having an air blower, and duct work connected to the air blower and configured to provide air from the blower to the housing, the duct work extending through a conduit in the housing to transport the air from the air blower to the housing, the duct work having an air outlet and comprising, as a part of at least one wall of the duct work, at least one flexible bladder that is configured to dampen out a pulsation or vibration caused in the housing by the EU, wherein the at least one flexible bladder prevents any flow of the air through the at least one flexible bladder.

2. The electrophotographic marking system of claim 1, wherein the at least one flexible bladder includes two flexible bladders that are parts of at least two walls of the duct work.

3. The electrophotographic marking system of claim 2, wherein the duct work comprises, adjacent an air inlet, a substantially rectangular shaped duct unit, and the two flexible bladders are positioned as parts of opposite walls of the duct unit.

4. The electrophotographic marking system of claim 1, wherein the at least one flexible bladder is positioned between the air blower and the air outlet.

5. The electrophotographic marking system of claim 1, wherein the duct work comprises at one end thereof an air inlet portion located adjacent to the air blower and at an opposite end thereof an air outlet that extends within the housing.

6. The electrophotographic marking system of claim 1, wherein the at least one flexible bladder comprises an expandable and flexible material having a thickness not exceeding about 1 mm.

7. An environmental unit (EU) configured for use in an electrophotographic marking apparatus, the EU comprising:

an air blower;

duct work connected at one end to an air inlet portion adjacent the air blower, the duct work having at an opposite end an air outlet portion, the air outlet portion configured to extend into a housing of the electrophotographic marking apparatus;

at least one flexible bladder positioned as a part of at least one wall of the duct work at a location between the air inlet portion and the air outlet portion, the bladder having one outer side adjacent the atmosphere outside of the duct work and an inner opposite side adjacent to air being transported by the EU, the bladder being configured to dampen out a pulsation or vibration caused in the housing of the electrophotographic marking apparatus, wherein the at least one flexible bladder prevents any flow of the air through the at least one flexible bladder.

8. The EU of claim 7, wherein the at least one flexible bladder includes two flexible bladders that are parts of at least two walls of the duct work.

9. The EU of claim 8, wherein the duct work comprises, adjacent an air inlet, a substantially rectangular shaped duct unit, and the two flexible bladders are positioned as parts of opposite walls of the duct unit.

10. The EU of claim 7, wherein the bladder is made of a material selected from the group consisting of rubber, latex, silicone and other suitable flexible materials.

11. The EU of claim 7, wherein the at least one flexible bladder comprises a material having a thickness not exceeding about 1 mm.

12. The EU of claim 7, wherein the at least one flexible bladder is tuned, configured and selected to respond to dampening out of any Hz pulsation caused by the air outlet blower.

13. The EU of claim 7, wherein the air blower is a rotary positive blower configured to move via the duct work the air from the EU to the housing of the electrophotographic marking apparatus.

14. The EU of claim 7, wherein the EU is configured to maintain temperature and humidity conditions within the housing.

15. The EU of claim 7, wherein the air blower is configured to introduce pulsation into an air stream of the air traveling through the duct work, the pulsation having a frequency of about from 200 to 400 Hz.

16. The EU of claim 7, wherein the at least one flexible bladder is configured to dampen the pulsation and avoid any banding in an image produced by the electrophotographic marking apparatus.

17. A duct work assembly configured to transport an air stream into an electrophotographic marking apparatus, the duct work comprising:

at one end of the duct work, an air inlet portion connected to an air blower;

at an opposite end of the duct work, an air outlet portion configured to be in air flow contact with the ectrophotographic marking apparatus;

a duct unit with a substantially rectangular configuration and having a first side wall; and at least one flexible bladder positioned as a part of the first side wall of the duct unit, the at least one flexible bladder being made from a material selected from the group consisting of rubber, latex, silicone and other flexible materials, and having a thickness not exceeding about 1 mm, wherein the at least one flexible bladder prevents any flow of the air stream through the at least one flexible bladder.

18. The duct work assembly of claim 17, wherein the duct unit further comprises a second side wall, the at least one flexible bladder includes two flexible bladders, a first one of the two flexible bladders is positioned as part of the first side wall of the duct unit, and a second one of the two flexible bladders is positioned as part of the second side wall of the duct unit.

19. The duct work assembly of claim 18, wherein the duct unit is substantially rectangular shaped, and the two flexible bladders are positioned as parts of opposite walls of the duct unit.

* * * * *